US005456100A

United States Patent [19]

Loomis

[11] Patent Number: 5,456,100

[45] Date of Patent: Oct. 10, 1995

[54] KNOCK-OUT PIN FOR BOLT MAKING MACHINE

[75] Inventor: Randal G. Loomis, Rosco, Ill.

[73] Assignee: Air Tuf Products, Inc., Phoenix, Ariz.

[21] Appl. No.: 213,219

[22] Filed: Mar. 14, 1994

[51] Int. Cl.[6] ..... B21J 13/14

[52] U.S. Cl. ..... 72/344; 470/152

[58] Field of Search ..... 72/344, 345; 470/141, 470/152, 205

[56] References Cited

U.S. PATENT DOCUMENTS

| | | | |
|---|---|---|---|
| 1,111,729 | 9/1914 | Blakeslee | 470/141 |
| 1,373,726 | 4/1921 | Heiby et al. | 72/344 |
| 3,171,144 | 3/1965 | Maistros | 470/152 |
| 3,728,892 | 4/1973 | Sangster | 470/205 |

*Primary Examiner*—Lowell A. Larson
*Attorney, Agent, or Firm*—LaValle D. Ptak

[57] ABSTRACT

A knock-out pin for a bolt making machine used for cold forming the heads of steel bolts is constructed with a convex pad on the end of the knock-out pin. The convex pad functions to progressively receive the shock as the head of the bolt is formed in the machine using the knock-out pin.

7 Claims, 1 Drawing Sheet

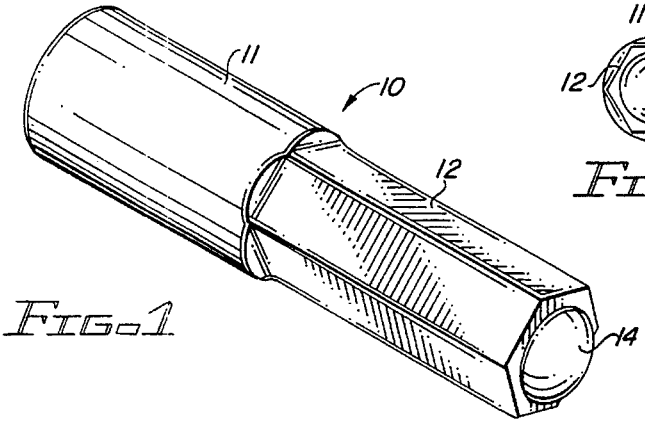
FIG. 1
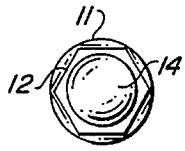
FIG. 2
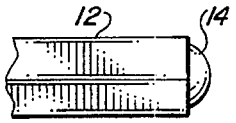
FIG. 3
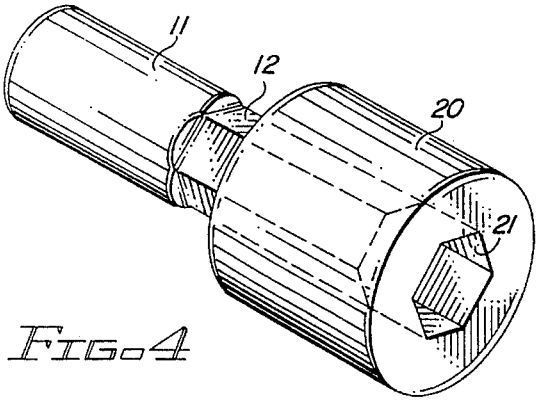
FIG. 4
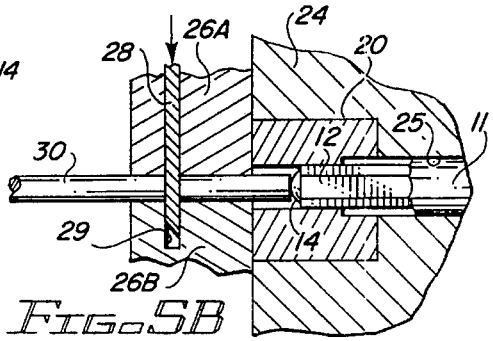
FIG. 5B
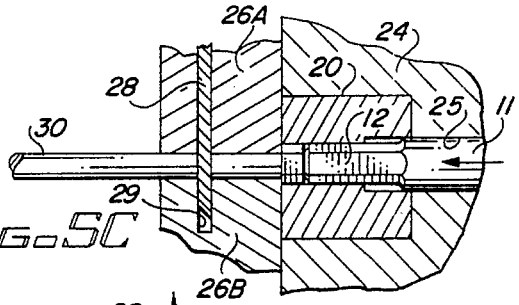
FIG. 5C
FIG. 5A
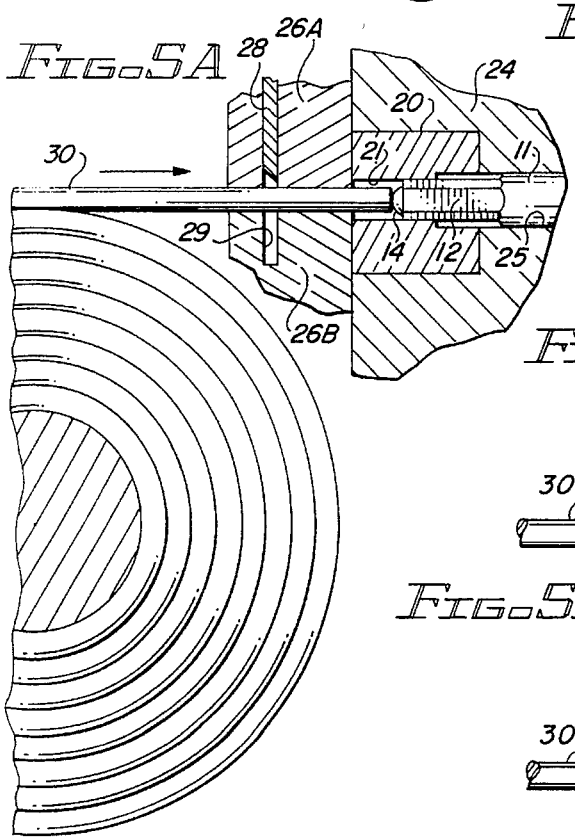
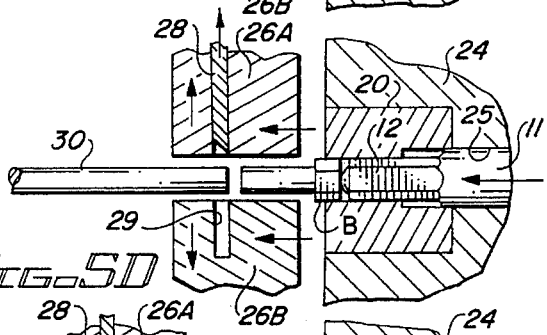
FIG. 5D
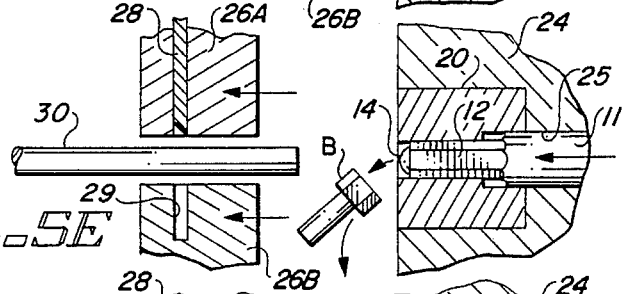
FIG. 5E
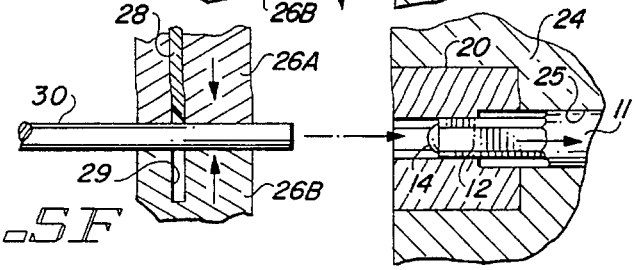
FIG. 5F

KNOCK-OUT PIN FOR BOLT MAKING MACHINE

BACKGROUND

Machines used for cold forming hexagonal heads on the ends of steel bolts are in widespread use. Typical machines form the bolts from a coil of steel wire which has the desired diameter necessary to form the shank of the bolt. The wire is fed through an opening in one part of the machine, to extend into a head-forming cavity. The internal configuration of the head-forming cavity is in the form of the proper dimensions of the head (usually a hex head) to be formed on the end of the bolt.

The opposite end of the cavity from the one into which the wire is fed has a movable knock-out pin in it. This knock-out pin is driven by a ram into the cavity to compress the wire to form the head on the end of the bolt. The knock-out pin has a pad on the end, which typically is in the form of a flat circular platform, having a diameter less than the smallest cross-sectional transverse diameter of the knock-out pin. This pad squeezes some of the metal at the top of the bolt hex head into the corners to ensure proper forming at the edges, which ultimately become edges at the top of the bolt. After the bolt is formed, the machine is opened; and the knock-out pin continues to move into the cavity to drive the bolt from the cavity. The knock-out pin and ram then are withdrawn to the original position, and the cycle is repeated.

Even in the manufacture of relatively small diameter bolts, tremendous forces are applied to the knock-out pin during the formation of the bolts when the press comes together to form the head on the end of the bolt. These forces are in the form of a hammer-like shock, and place significant stress on the knock-out pin. The initial shock is applied to the flat circular pad on the end of the knock-out pin. Operation of a typical bolt making machine generally results in frequent fracture type failures of the knock-out pins, which then must be replaced. During the times that the knock-out pins are being replaced in the machine, the machine cannot be operated for its intended function. Consequently, the "down time" during which a machine is unable to be operated for replacement of the knock-out pins has a significant impact on the productivity of the machine.

It is desirable to provide a knock-out pin for a cold forming steel bolt making machine which has increased life over presently known knock-out pins.

SUMMARY OF THE INVENTION

It is an object of this invention to provide an improved bolt making machine.

It is an additional object of this machine to provide an improved knock-out pin for a bolt making machine.

It is another object of this invention to provide an improved high durability knock-out pin for a bolt making machine.

It is a further object of this invention to provide a convex pad on the end of a knock-out pin for a bolt making machine to improve the durability of the knock-out pin.

In accordance with a preferred embodiment of this invention, an improvement is made in a bolt making machine for cold forming bolt heads on the end of a bolt. The machine includes an insert with a cavity in it dimensioned to shape the head of a bolt; and a knock-out pin closes one end of the cavity. The pin has a pad on the end of it, which has a convex surface to cause the knock-out pin progressively to receive shock as the knock-out pin engages the wire insert in the cavity to form a bolt head.

BRIEF DESCRIPTION OF THE DRAWING

FIG. 1 is a front perspective view of a preferred embodiment of the invention;

FIG. 2 is an end view of the embodiment shown in FIG. 1;

FIG. 3 is a partially cut-away side view of the embodiment shown in FIG. 1;

FIG. 4 shows a bolt head cavity insert in which the embodiment of FIG. 1 is used; and FIGS. 5A through 5F are progressive diagrammatic views showing the manner in which the embodiment of FIGS. 1 through 4 is used.

DETAILED DESCRIPTION

Reference now should be made to the drawing, in which the same reference numbers are used throughout the different figures to designate the same components. FIG. 1 is an enlarged perspective illustration of a knock-out pin 10 shaped in accordance with a preferred embodiment of this invention. The knock-out pin 10 illustrated in FIG. 1 is of a conventional shape and configuration, with the exception of the formation of a convex pad 14 on the end of a hexagonal shaft 12, which in turn extends from a cylindrical body portion 11. The body portion 11 and hexagonal portion 12 are of standard configuration for use in cold forming steel bolt making machines.

Knock-out pins having a flat pad on the right-hand end (as viewed in FIG. 1) are commonly in use today. Such knock-out pins are used in a bolt making machine in the manner illustrated in FIG. 4 by slidably inserting the hexagonal portion 12 of the knock-out pin into a correspondingly shaped hexagonal cavity 21 in an insert 20, which is placed in the bolt making machine. The dimensions of the hexagonal portion 12 of the knock-out pin and the internal dimensions of the cavity 21 in the insert 20 are selected to form a hexagonal head, of selected size or dimensions, on the end of a bolt, being made in the bolt making machine. Inserts 20, having cavities 21 of different sizes, may be used in the same bolt making machine; so that bolts of different sizes can be produced in different runs or at different times on the same machine.

In FIGS. 5A through 5F, the details of the operation of the machine are diagrammatically illustrated. It should be noted that the bolt making machine, which is diagrammatically shown in FIGS. 5A through 5F, is a standard or conventional machine; so that the structural details of such a machine are not shown in FIGS. 5A through 5F, since to do so is unnecessary. FIGS. 5A through 5F, however, do illustrate the basic operating characteristics of such machines; although the particular details of different machines and the manner and sequence of some of the operating cycle portions may differ from one machine to another. In common in all of these machines, however, is the utilization of a removable knock-out pin. In the knock-out pin of FIGS. 1 through 4, however, the pad 14 is a convex spherical section, centered on the end of the knock-out pin in alignment with the longitudinal axis through the center of the knock-out pin extending from the pad 14 through the cylindrical section 11.

In the operation of a bolt making machine, the cylindrical section 11 is connected in any suitable fashion to a ram for causing reciprocal movement of the hexagonal portion 12 in the mating hexagonal cavity 21 of the insert 20 during the formation of a hexagonal head on the end of a bolt. As illustrated in FIG. 5A, when a new bolt is to be made, a section of steel wire 30 having the proper external diameter is extended through the base of the machine 26A and 26B through a cylindrical hole through that base into the cavity 21 to rest against the end 14 of the knock-out pin 11/12.

The next step is to drive a shearing blade 28 downwardly to cut off the wire 30 to the desired length. The blade 28 is illustrated as passing through the wire 30 and into a slot 29 located beneath the wire 30, as shown in FIG. 5B. This then secures the severed portion of the wire 30 in place with the right-hand end (as viewed in FIGS. 5A through 5F) abutting the center or tip of the spherical convex pad 14 on the end of the hexagonal portion 12 of the knock-out pin.

As illustrated in FIG. 5C, the next step is for the ram 11 to be driven toward the left, pushing the knock-out pin 11/12 toward the left, as illustrated, to compress the end of the wire extending into the cavity 21 to fill the cavity and form the hexagonal head on the bolt. When this occurs, the pad 14 of the knock-out pin sinks into the end of the hexagonal head thus being formed, and forces the upper outer edges of the hex head bolt into the recesses of the cavity 21 to cause the upper outer edges of the bolt to be precisely formed.

It should be noted that as the ram compresses the wire 30 to form the bolt head, as illustrated in FIG. 5C, the initial compressive force impact is begun at the center of the spherical pad 14, and then rapidly spreads through the entire pad until all portions of the end of the knock-out pin engage the metal in the cavity 21 to form the head. This causes a progressive application of the force or shock to the knock-out pin, and progressively spreads the impact shock to the pin, rather than causing all of the shock to be applied at once. The wire 30 tends to commence spreading into the cavity 21 with this progressive shock, rather than a sudden simultaneous shock, which occurs if a standard flat pad is placed on the end of the hexagonal portion 12 of the knock-out pin.

The completion of the cycle of operation in forming a head on the bolt is illustrated in FIGS. 5D through 5E. In FIG. 5D, the portions 26A and 26B of the press are pulled back simultaneously with the retraction of the blade 28 to release the shank of the bolt from the machine. At the same time, the ram (not shown) continues to drive the knock-out pin 11/12 toward the left, as illustrated in FIG. 5D, to push the head of the bolt "B", which has thus been formed, out of the cavity 21.

This motion continues, as shown in FIG. 5E, to cause the bolt "B" to drop out of the machine. Once this operation has been completed, the portions 26A and 26B return to the position shown in FIG. 5A to grasp the wire 30 and then move back into the position of FIG. 5A. At the same time, the knock-out pin 11/12 is retracted to the initial position shown in FIG. 5A. The cycle then is repeated to form the next bolt.

It should be noted that the seemingly insignificant change, which has been made to the pad 14 on the end of the knock-out pin 11/12, has resulted in a significant extension of the life of the knock-out pin 11/12. This extension is four to ten times the life of prior art knock-out pins which are identical in all respects to the pin 11/12, except that the prior art pins have a flat pad on the end. Flat pads on the ends of knock-out pins for cold forming bolt making machines have long been in use. Even though the knock-out pins are made of high quality steel, relatively frequent fracturing of the prior art pins results during continued operation. By modifying the end of the pin to provide the convex spherical pad 14, significantly improved durability has been observed without any other changes being made in the knock-out pins or in the machines which they are used. This is believed to be the result of the progressive application of the impact force as the knock-out pin moves into and initiates spreading of the end of the steel wire used to form the bolt head during the initial impact stages.

The foregoing description of the preferred embodiment of the invention is to be considered as illustrative, and not as limiting. Various changes and modifications will occur to those skilled in the art to produce a device which performs substantially the same function, in substantially the same way, to achieve substantially the same result, without departing from the true scope of the invention as defined in the appended claims.

I claim:

1. In a bolt making machine for cold-forming bolt heads on the end of a bolt, said machine including a ram carrying an insert with a cavity dimensioned to shape a bolt head, and including a knock-out pin closing one end of the cavity for movement into the cavity to eject finished bolts formed therein at the end of each cycle of operation of said machine, an improvement comprising a pad with a convex surface on the end of said knock-out pin which closes said one end of said cavity for progressively receiving shock; said convex surface of said pad having a maximum diameter which is less than the shortest transverse dimension across said knock-out pin.

2. The combination according to claim 1 wherein said knock-out pin has a central longitudinal axis and said pad on the end of said knock-out pin has a center which coincides with said central longitudinal axis.

3. The combination according to claim 2 wherein the convex surface on the end of said knock-out pin is a spherical section.

4. The combination according to claim 3 wherein the cross section of said knock-out pin adjacent the end on which said pad is located is hexagonal.

5. The combination according to claim 1 wherein the convex surface on the end of said knock-out pin is a spherical section.

6. The combination according to claim 5 wherein said knock-out pin has a central longitudinal axis and said pad on the end of said knock-out pin has a center which coincides with said central longitudinal axis.

7. The combination according to claim 1 wherein the cross section of said knock-out pin adjacent the end on which said pad is located is hexagonal.

* * * * *